US010402024B2

(12) United States Patent
Lo et al.

(10) Patent No.: US 10,402,024 B2
(45) Date of Patent: Sep. 3, 2019

(54) INTEGRATED COMMUNICATION AND CAPACITIVE SENSING CIRCUIT AND INTERACTIVE SYSTEM USING THE SAME

(71) Applicant: Generalplus Technology Inc., Hsinchu (TW)

(72) Inventors: Li Sheng Lo, Zhubei (TW); Hsien-Yao Li, Hsinchu (TW)

(73) Assignee: GENERALPLUS TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/612,697

(22) Filed: Jun. 2, 2017

(65) Prior Publication Data

US 2017/0351359 A1 Dec. 7, 2017

(30) Foreign Application Priority Data

Jun. 3, 2016 (TW) ..... 105117509 A

(51) Int. Cl.
*G06F 3/044* (2006.01)
*A63H 3/02* (2006.01)
(Continued)

(52) U.S. Cl.
CPC ..... *G06F 3/044* (2013.01); *A63H 3/02* (2013.01); *A63H 3/28* (2013.01); *A63H 3/36* (2013.01);
(Continued)

(58) Field of Classification Search
CPC ..... G06F 3/044; G06F 3/0416; G06F 1/1698; G06F 3/03545; G06F 1/1684;
(Continued)

(56) References Cited

U.S. PATENT DOCUMENTS 6,515,654 B1 * 2/2003 Liao ..... G06F 3/03545 178/18.01
8,378,967 B2 * 2/2013 Noda ..... G06F 3/038 178/18.07
(Continued)

*Primary Examiner* — Jose R Soto Lopez
(74) *Attorney, Agent, or Firm* — Muncy, Geissler, Olds & Lowe, P.C.

(57) ABSTRACT

An integrated communication and capacitive sensing circuit and an interactive system using the same are provided in the present invention. The integrated communication and capacitive sensing circuit includes a microprocessor, a sensing electrode and a resonant circuit. The microprocessor includes a first input/output (I/O) pin and a second I/O pin. The sensing electrode is coupled to the first I/O pin of the microprocessor. The input terminal of the resonant circuit is coupled to the second I/O pin of the microprocessor, and the output terminal of the resonant circuit is coupled to the sensing electrode. When sensing the capacitance is performed, the first I/O pin of the microprocessor detects the charging/discharging state of the sensing electrode to determine the capacitive variation. When a data output is performed, the first I/O pin of the microprocessor is set to high impedance, and the second I/O pin of the microprocessor outputs or does not output a high frequency carrier according to a transmission data, wherein the resonant circuit amplifies the amplitude of the high frequency carrier.

8 Claims, 11 Drawing Sheets

(51) Int. Cl.

| | |
|---|---|
| ***A63H 3/28*** | (2006.01) |
| ***A63H 3/36*** | (2006.01) |
| ***A63H 33/26*** | (2006.01) |
| ***G06F 3/041*** | (2006.01) |

(52) U.S. Cl.
CPC ..... *A63H 33/26* (2013.01); *G06F 3/0416* (2013.01); *A63H 2200/00* (2013.01)

(58) Field of Classification Search
CPC . A63H 33/26; A63H 3/36; A63H 3/02; A63H 3/28; A63H 2200/00; H01Q 1/245; H01Q 1/1257; H03K 17/955
See application file for complete search history.

(56) References Cited

U.S. PATENT DOCUMENTS 8,798,695 B1 * 8/2014 Zheng ..... G06F 1/1698 455/575.7
2008/0100522 A1 * 5/2008 Inaba ..... B60R 25/246 343/713
2012/0075242 A1 * 3/2012 Hotelling ..... G06F 3/044 345/174
2014/0087786 A1 * 3/2014 Tani ..... H04M 1/026 455/556.1
2016/0076952 A1 * 3/2016 Kim ..... H03K 17/962 345/173
2016/0094271 A1 * 3/2016 Kawano ..... H03K 3/01 375/130
2016/0127523 A1 * 5/2016 Rouaissia ..... H04M 1/0266 455/566
2016/0182250 A1 * 6/2016 Pourseyed ..... H04L 12/40013 710/316
2016/0198410 A1 * 7/2016 Cherniavsky ..... H04W 52/0229 370/278
2017/0242502 A1 * 8/2017 Gray ..... G06F 3/0346
2017/0242534 A1 * 8/2017 Gray ..... G06F 3/044

* cited by examiner

INTEGRATED COMMUNICATION AND CAPACITIVE SENSING CIRCUIT AND INTERACTIVE SYSTEM USING THE SAME

This application claims priority of No. 10/5117509 filed in Taiwan R.O.C. on Jun. 3, 2016 under 35 USC 119, the entire content of which is hereby incorporated by reference.

BACKGROUND OF THE INVENTION

Field of the Invention

The invention relates to the technology of a communication circuit, and more particularly to an integrated communication and capacitive sensing circuit and an interactive system using the same.

Description of the Related Art

FIG. 1 illustrates a transceiver circuit according to a prior art of communication technology. Referring to FIG. 1, the transceiver includes an antenna 101, a transmitter circuit 102, a modulation circuit 103, a amplifier circuit 104, a filter circuit 105, a comparing circuit 106 and a demodulation circuit 107. When a signal is received by the antenna 101, the amplifier circuit 104 pre-amplifies the received signal, and then the filter circuit 105 and the comparing circuit 106 performs the waveform process. Finally, the demodulation circuit 107 performs the demodulation to obtain a receiving data. In addition, when a data is to be transmitted, the data would be modulated by the modulation circuit 103, and then after the signal process of the transmitter circuit 102, the antenna 101 outputs the transmission signal.

However, in the present circuit, to achieve the touch function and data transceiver/communication function, the implementation would be to add another circuit block in FIG. 1 to control the touch function. Thus, it causes the complexity of the circuit to achieve the touch function and data transceiver/communication function. The occupied area of the circuit would be greater, and the product size and weight would become greater.

SUMMARY OF THE INVENTION

An aspect of the present invention is to provide an integrated communication and capacitive sensing circuit and an interactive system using the same, to achieve communication function and capacitive sensing function in the same device with lesser elements.

Another aspect of the present invention is to provide an integrated communication and capacitive sensing circuit and an interactive system using the same, to reduce the product size by using lesser elements in the product.

In view of this, the present invention provides an integrated communication and capacitive sensing circuit. The integrated communication and capacitive sensing circuit includes a microprocessor, a sensing electrode and a resonant circuit. The microprocessor includes a first input/output pin and a second input/output pin. The sensing electrode is coupled to the first input/output pin of the microprocessor. The resonant circuit includes an input terminal and an output terminal. The input terminal of the resonant circuit is coupled to the second input/output pin of the microprocessor. The output terminal of the resonant circuit is coupled to the sensing electrode. When a capacitive sensing is performed, the microprocessor determines the capacitive variation of the sensing electrode according to the charging/discharging status of the sensing electrode from the first input/output pin. When a data transmission is performed, the first input/output pin of the microprocessor is set to high impedance; a high frequency carrier signal of the second input/output pin of the microprocessor is enabled/disabled according to a transmission data, wherein a magnitude of the high frequency carrier signal is amplified by the resonant circuit.

The present invention further provides an interactive system. The interactive system includes a first interactive device and a second interactive device. The first interactive device includes a first integrated communication and capacitive sensing circuit. The first integrated communication and capacitive sensing circuit includes a first microprocessor, a first sensing electrode and a first resonant circuit. The first microprocessor includes a first input/output pin and a second input/output pin. The first sensing electrode, coupled to the first input/output pin of the first microprocessor. The first resonant circuit includes an input terminal and an output terminal. The input terminal of the first resonant circuit is coupled to the second input/output pin of the first microprocessor. The output terminal of the first resonant circuit is coupled to the first sensing electrode. The second interactive device includes a second integrated communication and capacitive sensing circuit. The second integrated communication and capacitive sensing circuit includes a second microprocessor, a second sensing electrode and an output circuit. The second microprocessor includes a first input/output pin and a second input/output pin. The second sensing electrode is coupled to the first input/output pin of the second microprocessor. The output circuit, coupled to the second integrated communication and capacitive sensing circuit. When the first integrated communication and capacitive sensing circuit performs a capacitive sensing, the first microprocessor determines the capacitive variation of the first sensing electrode according to a charging/discharging status of the first sensing electrode from the first input/output pin of the first microprocessor. When the first interactive device performs data output, the first input/output pin of the first microprocessor is set to high impedance, and a high frequency carrier signal of the second input/output pin of the first microprocessor is enabled/disabled according to a transmission data, wherein a magnitude of the high frequency carrier signal is amplified by the first resonant circuit. When the second interactive device receives transmission data from the first interactive device, the second microprocessor determines envelop of the high frequency carrier from the second sensing electrode to decode the transmission data transmitted from the first interactive device according to a time period of unstable capacitance detected by the first input/output pin of the second microprocessor. The second integrated communication and capacitive sensing circuit controls the output circuit outputs a corresponding output according to the transmission data.

In the integrated communication and capacitive sensing circuit according to a preferred embodiment of the present invention, the microprocessor includes a third input/output pin. The integrated communication and capacitive sensing circuit further includes a impedance element. The impedance element includes a first terminal and a second terminal, wherein the first terminal of the impedance element is coupled to the third input/output pin of the microprocessor, and the second terminal of the impedance element is coupled to the first input/output pin of the microprocessor. When the capacitive sensing is performed, the first input/output pin of the microprocessor is set to a first common voltage, and then the first input/output pin of the microprocessor is set to high impedance, and the third input/output pin of the microprocessor is set to a first specific voltage, when a voltage of the sensing electrode is charged from the first common voltage to a first voltage, the first input/output pin of the microprocessor is set to a second common voltage, the first input/output pin of the microprocessor is set to high impedance, and the third input/output pin of the microprocessor is set to a second specific voltage. When the sensing electrode is discharged from the second common voltage to a second voltage, the first input/output pin of the microprocessor is set to the first common voltage, and then the first input/output pin of the microprocessor is set to high impedance, and the third input/output pin of the microprocessor is set to the first specific voltage. The microprocessor determines the capacitive variation of the sensing electrode according to a period when the sensing electrode is charged from the first common voltage to the first voltage plus a period when the sensing electrode is discharged from the second common voltage to the second voltage, wherein the first specific voltage is greater than or equal to the first voltage, and the first voltage is greater than the first common voltage, wherein the second specific voltage is smaller than or equal to the second voltage, and the second voltage is smaller than the second common voltage.

In the integrated communication and capacitive sensing circuit according to a preferred embodiment of the present invention, the microprocessor includes a third input/output pin. The integrated communication and capacitive sensing circuit further includes a impedance element. The impedance element includes a first terminal and a second terminal, wherein the first terminal of the impedance element is coupled to the third input/output pin of the microprocessor, and the second terminal of the impedance element is coupled to the first input/output pin of the microprocessor. When the capacitive sensing is performed, the first input/output pin of the microprocessor is set to a first common voltage, and then the first input/output pin of the microprocessor is set to high impedance, and the third input/output pin of the microprocessor is set to a first specific voltage such that the sensing electrode is charged from the third input/output pin of the microprocessor. After a first preset period, the microprocessor records a first time-point voltage of the sensing electrode, the first input/output pin of the microprocessor is set to a second common voltage, and then the first input/output pin of the microprocessor is set to high impedance, and the third input/output pin of the microprocessor is set to a second specific voltage such that the sensing electrode is discharged to the third input/output pin of the microprocessor, After a second period, the microprocessor records a second time-point voltage of the sensing electrode, the first input/output pin of the microprocessor is set to a first common voltage, and then the first input/output pin of the microprocessor is set to high impedance, and the third input/output pin of the microprocessor is set to a first specific voltage. The microprocessor determines the capacitive variation of the sensing electrode according to the first time-point voltage and the second time-point voltage, wherein the first specific voltage is greater than or equal to the first time-point voltage, and the first time-point voltage is greater than the first common voltage, wherein the second specific voltage is smaller than or equal to the second time-point voltage, and the second time-point voltage is smaller than the second common voltage.

In the integrated communication and capacitive sensing circuit according to a preferred embodiment of the present invention, the integrated communication and capacitive sensing circuit further includes a impedance element. The impedance element includes a first terminal and a second terminal, wherein the first terminal of the impedance element is coupled to the first input/output pin of the microprocessor, and the second terminal of the impedance element is coupled to a common voltage. When the capacitive sensing is performed, the first input/output pin of the microprocessor charges the sensing electrode to a first voltage, and then the first input/output pin of the microprocessor is set to high impedance. When the sensing electrode is discharged to a second voltage, the microprocessor determines the capacitive variation of the sensing electrode according to a period when the sensing electrode discharged from the first voltage to the second voltage.

In the integrated communication and capacitive sensing circuit according to a preferred embodiment of the present invention, the integrated communication and capacitive sensing circuit further includes a impedance element. The impedance element includes a first terminal and a second terminal, wherein the first terminal of the impedance element is coupled to the first input/output pin, and the second terminal of the impedance element is coupled to a common voltage. When the capacitive sensing is performed, the first input/output pin of the microprocessor charges the sensing electrode to a first voltage, and then the first input/output pin of the microprocessor is set to high impedance, and after a preset period, the microprocessor determines the capacitive variation of the sensing electrode according to a voltage to which the sensing electrode discharged from the first voltage.

In the integrated communication and capacitive sensing circuit according to a preferred embodiment of the present invention, the microprocessor includes a fourth input/output pin. The resonant circuit includes an inductor, a capacitor and a resistor. The inductor includes a first terminal and a second terminal, wherein the first terminal of the inductor is coupled to the second input/output pin of the microprocessor, and the second terminal of the inductor is coupled to the sensing electrode. The capacitor includes a first terminal and a second terminal, wherein the first terminal of the capacitor is coupled to the fourth input/output pin of the microprocessor, and the second terminal of the capacitor is coupled to the sensing electrode. The resistor includes a first terminal and a second terminal, wherein the first terminal of the resistor is coupled to the second input/output pin of the microprocessor, the second terminal of the resistor is coupled to the first terminal of the inductor. When the data transmission is performed, the first input/output pin of the microprocessor is set to high impedance, and the fourth input/output pin of the microprocessor is set to a common voltage. When the capacitive sensing is performed, the second input/output pin of the microprocessor and the fourth input/output pin of the microprocessor is set to high impedance.

In the integrated communication and capacitive sensing circuit according to a preferred embodiment of the present invention, the microprocessor determines envelop of the high frequency carrier to decode a transmission data transmitted from a external circuit according to the time period of unstable capacitance detected by the first input/output pin of the microprocessor.

The essence of the present invention is to output a high frequency carrier signal from a I/O pin of the microprocessor and then to use the resonant circuit which resonates the high frequency carrier signal such that the electric field of the high frequency carrier signal is amplified and the sensing electrode can emits the amplified electric field of the high frequency carrier signal. Moreover, the other pin of the microprocessor is used to sense the capacitance of the sensing electrode. Thus, the circuit design provided by the present invention adopts the same sensing electrode to achieve the data transceiving function and the capacitance sensing function.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

DETAILED DESCRIPTION OF THE INVENTION

Figure 1:
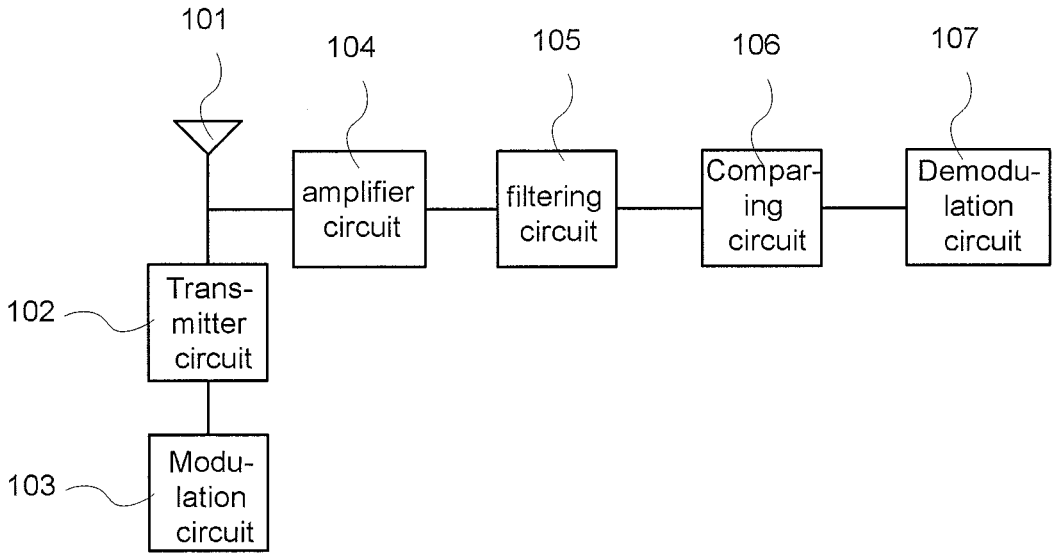
FIG. 1 (Prior Art)
FIG. 1 illustrates a transceiver circuit according to a prior art of communication technology.
Figure 2:
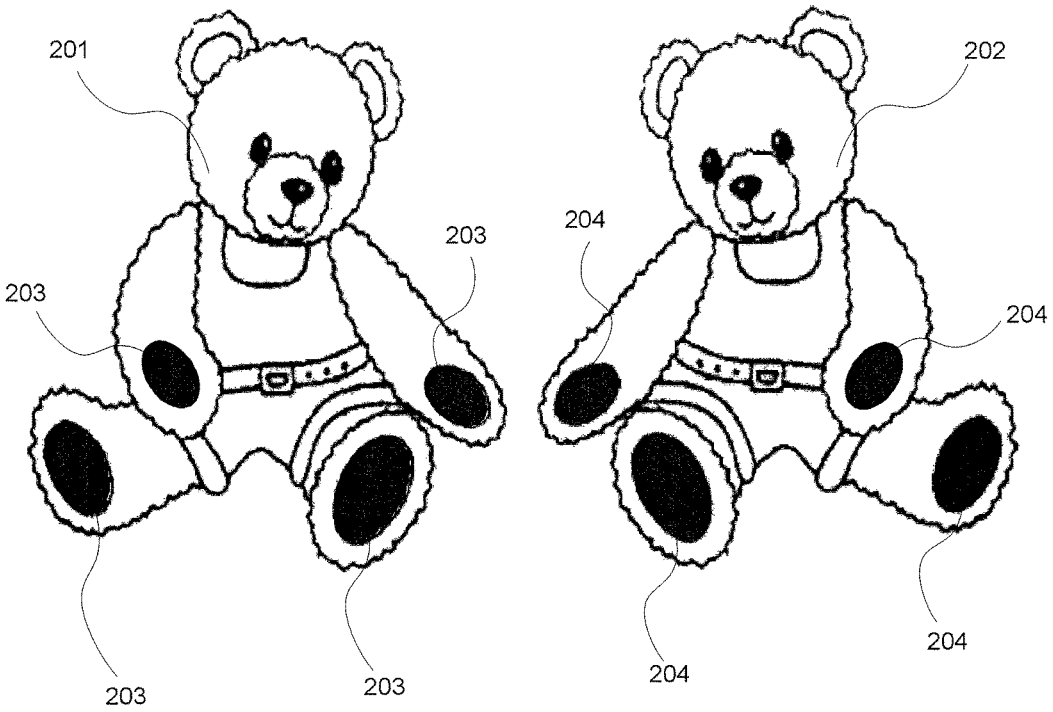
FIG. 2 illustrates a diagram showing an interactive system according to a preferred embodiment of the present invention.

FIG. 2 illustrates a diagram showing an interactive system according to a preferred embodiment of the present invention. Referring to FIG. 2, the interactive system includes a first interactive device 201 and a second interactive device 202. The first interactive device 201 has four capacitive sensing electrodes 203. The second interactive device 202 has four capacitive sensing electrodes 203. In this embodiment, the first interactive device 201 is a doll and the second interactive device 202 also is a doll. When user use finger to touch one of the capacitive sensing electrode 203, the first interactive device 201 would play a voice or respond a movement. Similarly, when user use finger to touch one of the capacitive sensing electrode 204, the second interactive device 202 would play a voice or respond a movement. In the following embodiment, the original exist capacitive sensing electrodes 203 and 204 are adopted to perform communication such that two interactive devices 201 and 202 can identify user's finger, contact between the capacitive sensing electrode 203 of the first interactive device 201 and the capacitive sensing electrode 204 of the first interactive device 202, contact between the capacitive sensing electrode 203 of the first interactive device and contact between the capacitive sensing electrode 204 of the first interactive device 202.

Figure 3:
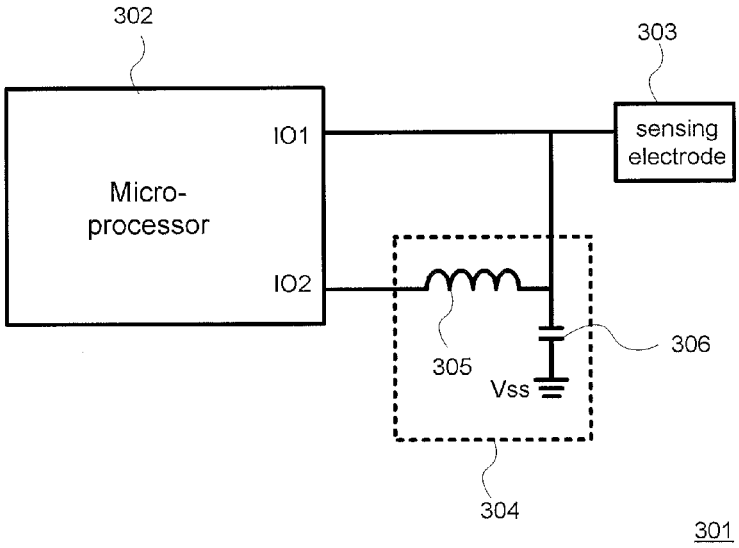
FIG. 3 illustrates a circuit diagram of the first interactive device 201 according to a preferred embodiment of the present invention.

FIG. 3 illustrates a circuit diagram of the first interactive device 201 according to a preferred embodiment of the present invention. Referring to FIG. 3, the first interactive device 201 includes an integrated communication and capacitive sensing circuit 301. The integrated communication and capacitive sensing circuit 301 includes a microprocessor 302, a sensing electrode 303 and a resonant circuit 304. The microprocessor 302 in this embodiment includes a first input/output (I/O) pin IO1 and a second I/O pin IO2. The sensing electrode 303 is coupled to the first I/O pin IO1 of the microprocessor 302. In this embodiment, the resonant circuit 304 is implemented by an inductor 305 and a capacitor 306. One terminal of the inductor 305 is coupled to the second I/O pin IO2 of the microprocessor 302, the other terminal of the inductor 305 is coupled to one terminal of the capacitor 306 and the sensing electrode 303. The other terminal of the capacitor 306 is coupled to the common voltage VSS.

Figure 4:
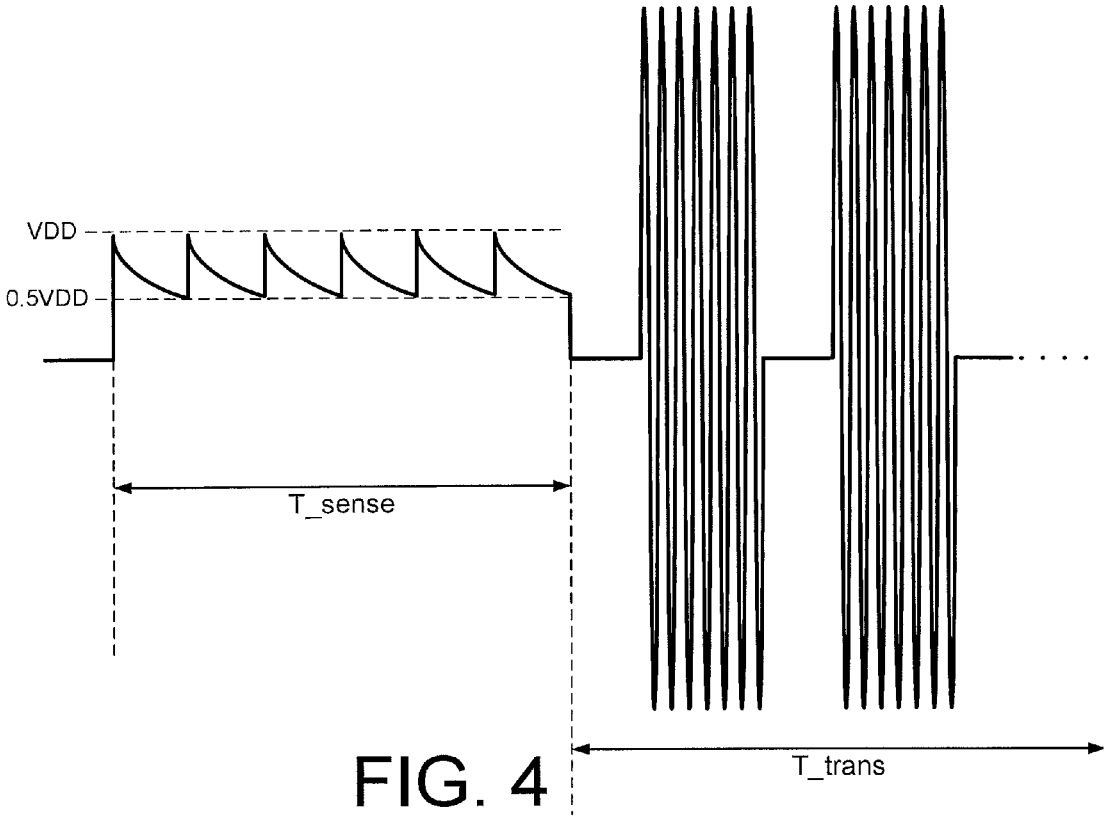
FIG. 4 illustrates an operational waveform diagram of the integrated communication and capacitive sensing circuit 301 according to a preferred embodiment of the present invention.

FIG. 4 illustrates an operational waveform diagram of the integrated communication and capacitive sensing circuit 301 according to a preferred embodiment of the present invention. The operation of the integrated communication and capacitive sensing circuit 301 is divided into the capacitive sensing period T_sense and the data transmission period T_trans. When the operation is in the capacitive sensing period T_sense, the second I/O pin IO2 of the microprocessor 302 is set to high impedance. The microprocessor 302 charges the sensing electrode 303 and the capacitor 306 through its first I/O pin IO1. Next, when the voltage of the sensing electrode 303 is charged to VDD, the microprocessor 302 sets its first I/O pin IO1 to high impedance, and the sensing electrode 303 and the capacitor 306 start to discharge. At the same time, the first I/O pin IO1 of the microprocessor 302 detects the discharging voltage. When the voltage of the sensing electrode 303 and the capacitor 306 is discharged to VDD/2, the microprocessor 302 restart to charge the sensing electrode 303 and the capacitor 306 through its first I/O pin IO1, and so on. The charging and discharging are repeatedly performed. In the capacitive sensing period T_sense, if user's finger is close to the sensing electrode 303, the equivalent capacitance of the sensing electrode 303 is increased. Thus, the charging/discharging time would be increased. So, the microprocessor 302 can determines the capacitive variation of the sensing electrode 303 according to the charging/discharging time of the sensing electrode 303 detected by the first I/O pin IO1 of the microprocessor 302, such that the microprocessor 302 can determine whether a user touches the interactive device 201.

Next, when the operation is in the data transmission period T_trans, the first I/O pin IO1 of the microprocessor 302 is set to high impedance, and the microprocessor 302 performs a modulation according to a transmission data, wherein the microprocessor 302 determines to enable/disable a high frequency carrier signal to its second I/O pin IO2. Since the frequency of the high frequency carrier signal is close to the resonant frequency of the resonant circuit 304, the magnitude of the high frequency carrier signal is amplified by the resonance of the resonant circuit 304. At the same time, the sensing electrode 303 outputs the amplified high frequency carrier signal.

Figure 5:
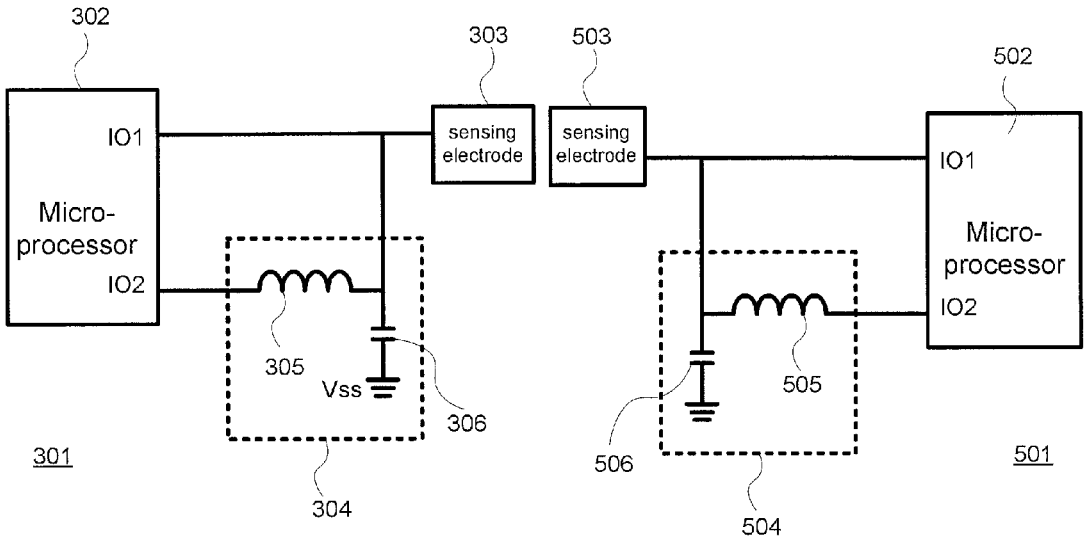
FIG. 5 illustrates a schematic diagram depicting two close sensing electrodes with peripheral circuit according to a preferred embodiment of the present invention.

In the embodiment of the present invention, the sensing electrodes of two interactive device 201 and 202 close to each other is as shown in FIG. 5, FIG. 5 illustrates a schematic diagram depicting two close sensing electrodes with peripheral circuit according to a preferred embodiment of the present invention. Referring to FIG. 5, it illustrates two integrated communication and capacitive sensing circuits 301 and 501 and two output circuit 311 and 511, wherein the integrated communication and capacitive sensing circuit 301 is disclosed as shown in FIG. 3, and the output circuit 311 is coupled to the microprocessor. The integrated communication and capacitive sensing circuit 501 includes a microprocessor 502, a sensing electrode 503 and a resonant circuit 504. Because the operation of the integrated communication and capacitive sensing circuit 501 is the same as the operation of the integrated communication and capacitive sensing circuit 301, the detail description is omitted. In addition, the output circuit 511 is coupled to the microprocessor 502.

In this embodiment, the sensing electrode 303 is disposed on the first interactive device 201, and the sensing electrode 503 is disposed on the second interactive device 202. In order to conveniently describe the present embodiment, it is assumed that two sensing electrodes 303 and 305 are respectively disposed on the hands of two dolls. Further, the two hand of the two dolls are close to or contact with each others, it means two sensing electrodes 303 and 503 are close to each others. And, it is assumed that the sensing electrode 503 receives the high frequency carrier signal output from the sensing electrode 303 in the capacitive sensing period T_sense. At this time, because the sensing electrode 503 receives rapid variation of electric field, the microprocessor 502 detects that the voltage of the sensing electrode 503 and the capacitor 506 are discharged to VDD/2. The microprocessor 502 determines that the capacitance value becomes pretty small according to the charging/discharging time from VDD to VDD/2 (RC time constant). This situation is not going to happen in physical phenomenon. Therefore, the microprocessor 502 would determines that there are external data to be transmitted. The microprocessor 502 would switch to the data receiving mode. In other words, Due to the effect of the external electric field, the microprocessor 502 detects rapid and unstable variation of electric field, such that the microprocessor 502 determines that receiving data should be performed and the microprocessor 502 controls that the integrated communication and capacitive sensing circuit 501 operates in data receiving mode.

Figure 6:
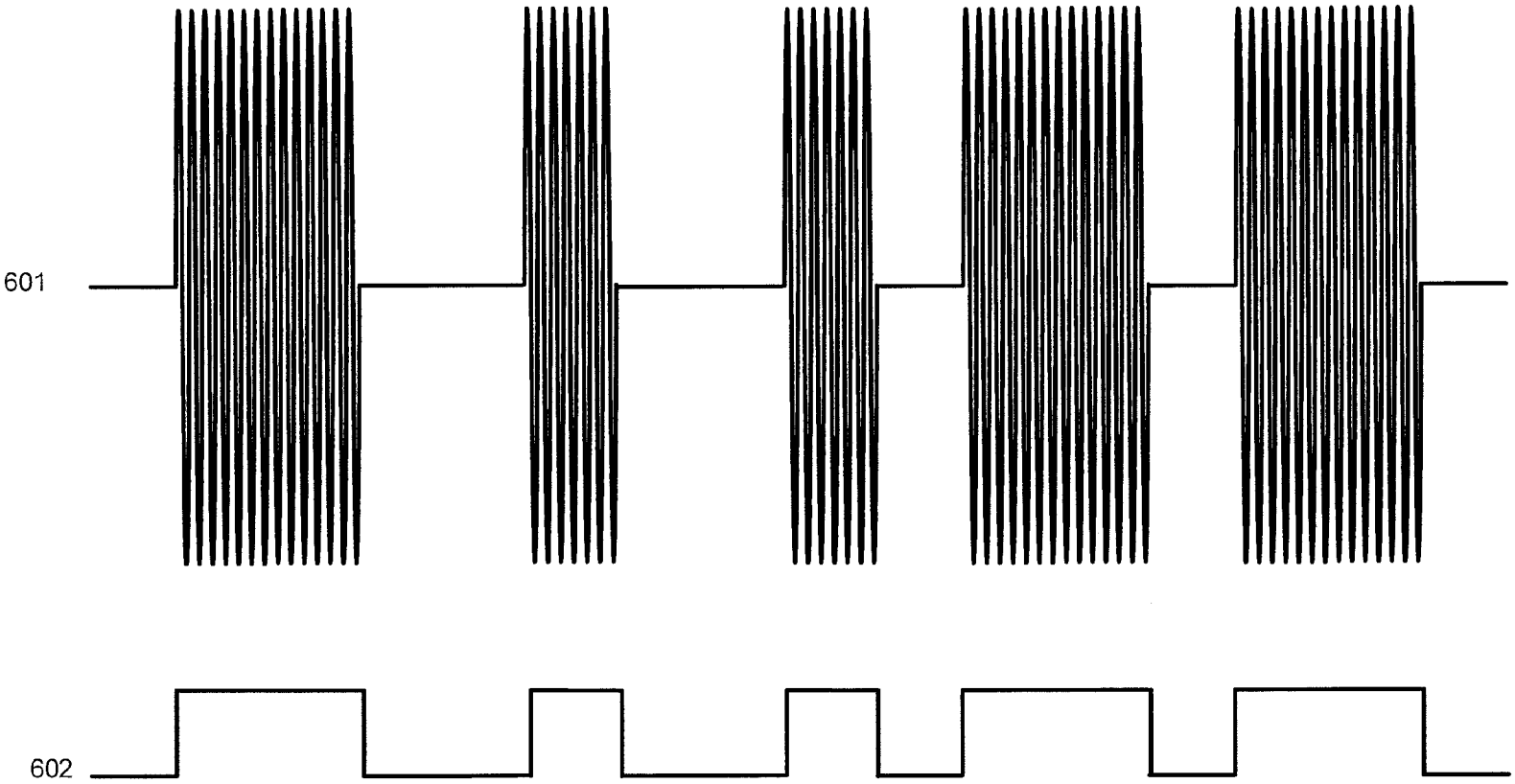
FIG. 6 illustrates a waveform diagram depicting a data transmission according to a preferred embodiment of the present invention.

FIG. 6 illustrates a waveform diagram depicting a data transmission according to a preferred embodiment of the present invention. Referring to FIG. 6, the waveform 601 is the waveform output from the transmitter. The transmitter of the embodiment may be the integrated communication and capacitive sensing circuit 301. Moreover, in FIG. 6, the transmitter may use the length of the maintenance time of the high frequency carrier signal to represent the transmission data. Further, the waveform 602 in FIG. 6 illustrates the envelop waveform from the receiver, wherein the receiver in the embodiment is the integrated communication and capacitive sensing circuit 501. In the present embodiment, the microprocessor 503 of the receiver is in the capacitive sensing mode at this time. When the transmitter is transmitting the high frequency carrier signal, the microprocessor detects that the voltage of the sensing electrode 503 reaches VDD/2 in a very short time, due to the affection of rapid variation of the electric field received by the sensing electrode. At this time, the microprocessor 502 evaluates that the capacitance value, which is the capacitance value of the sensing electrode 503 plus the capacitance value of the capacitor 506 in this embodiment, is smaller than a normal capacitance value according to the time when the voltage is discharged from VDD to VDD/2 (RC charging/discharging time). When there is no high frequency carrier signal, the sensing electrode 503 of the receiver is not affected by external electric field, the sensing electrode 503 and the capacitor 506 is operated in a normal charging/discharging time. Thus, the microprocessor 502 evaluates that the value of the capacitance is not be changed. In other words, if the transmitter transmits the high frequency carrier signal, the receiver would detect that the capacitance value is lower than a normal capacitance value. On the contrary, if the transmitter does not transmit the high frequency carrier signal, the receiver detects that the capacitance value is substantially equal to the original capacitance value. Thus, the receiver can capture the envelop of the output data transmitted by transmitter to demodulate the transmission data of the transmitter.

In this embodiment, the transmission data may be an interactive instruction or device information and so on. When the receiver obtain the transmission data by demodulation, the microprocessor 502 drives the output circuit 511 to output a corresponding effect according to the transmission data for performing a corresponding interaction, such as a specific sound or a specific movement. In this embodiment, the transmission data may include a device code field, wherein the device code field is for carrying the code of the interactive device. For example, the first interactive device 201 and the second interactive device 202 respectively have different device codes. When the hands of two dolls are contact to each others, that is to say, the sensing electrode 303 is close to the sensing electrode 503, the data transmission starts. The receiver can obtain the code of the interactive device 201. After that, the microprocessor 501 determines that the transmitter is an interactive device, and then the microprocessor 501 drives the output circuit to perform a corresponding interaction, such as emitting voice "hello".

Because the transmission data includes a device code, the receiver would identify whether the sensing electrode close to the receiver's sensing electrode is the receiver's sensing electrode (local machine) or the sensing electrode of the other device by the device code, such that the following interaction can be determined. For example, two sensing electrodes are respectively disposed on the two hand of the first interactive device 201. When the hand of the doll touches the other hand of the doll, the internal microprocessor 302 determines that the contact sensing electrode is the sensing electrode of local machine by the device code field of the transmission data, and then drives the output circuit 311 to perform a corresponding interaction, such as outputting a laughing sound effect. In other words, the present invention can be used for performing the interaction between two interactive devices or the interaction of signal interactive device.

In the embodiment of FIG. 2, there are four sensing electrodes in a doll. In the present embodiment, the transmission data may also includes the location information of the four sensing electrodes. Therefore, when two sensing electrodes transmit data, the receiver can not only receive the device code, but receive the location information for the sensing electrode such that the different interaction can be performed. For example, when the doll's hand (the first interactive device 201) touches the other doll's foot (the second interactive device 202), the internal microprocessor determines that the sensing electrode which touches the device is the sensing electrode being disposed on the foot of the other device according to the location information and the device code of the transmission data, such that the output circuit is driven to perform a corresponding interaction, such as outputting an angry yelling sound effect.

The abovementioned codes may be disposed on the preamble of the transmission data, and it has a fixed data format. Thus, when the receiver performs the demodulation, the preamble can be used for performing data synchronization and for determining whether the received data is interference or not.

In addition, the transmission data may include a message field for carrying an interactive instruction or a specific message and so on. For example, the transmission data includes the doll's name (such as Mary). When the hand of the interactive device 201 is close to the hand of the interactive device 202, the interactive device 201 outputs the transmission data to the sensing electrode of the interactive device 202 through its sensing electrode 303. After the microprocessor 502 of the interactive device 202 demodulates the transmission data, the microprocessor 502 drives the output circuit to perform a corresponding interaction, such as outputting a sound effect "Hi, Mary".

In the abovementioned embodiment, the interactive device includes four sensing electrodes, and the sensing electrodes are disposed on the hands and feet. However, people having ordinary skill in the art should know that the number of the sensing electrode of the interactive device is designed according to the product, and the location of the sensing electrode is also designed according to the product. For example, the sensing electrode may also be disposed on the head or belly. Further, the output circuit in the abovementioned embodiment is a speaker to perform various specific sound effect interactions. However, people having ordinary skill in the art should know that the output circuit may be a different kind of driving circuit for performing different type interaction, such as driving the doll to perform a specific movements or specific light effects and so on. Moreover, the interactive device in the abovementioned embodiment is a doll. However, people having ordinary skill in the art should know that the present invention also may be implemented in the other electronic products or household appliances.

In the data transmission period T_trans in the abovementioned embodiment, after the modulation of the transmission data, the transmitter then determines whether the high frequency carrier signal is enabled. Taking FIG. 6 as an example, the transmitter may adopts pulse width modulation (PWM), the greater duty cycle period represents data "1", and the smaller duty cycle period represents data "0". However, people having ordinary skill in the art should know that the present invention is not limited to the PWM modulation. Except for PWM, the PPM (Pulse Position Modulation), Manchester encoding, Bi-Phase encoding and other digital encoding may also be adopted in the present invention.

Figure 7:
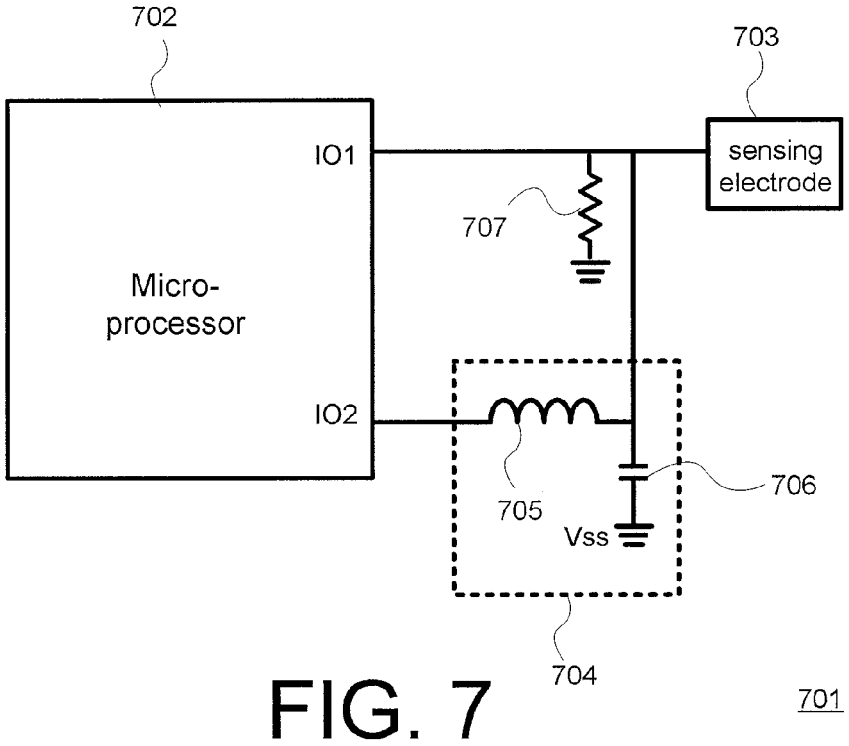
FIG. 7 illustrates a circuit diagram of the first interactive device 201 according to a preferred embodiment of the present invention.

In order to let people having ordinary skill in the art can be able to implement the present invention, another embodiment is provided to describe the circuit of the interactive device. FIG. 7 illustrates a circuit diagram of the first interactive device 201 according to a preferred embodiment of the present invention. Referring to FIG. 7, the interactive device 201 includes an integrated communication and capacitive sensing circuit 701. The integrated communication and capacitive sensing circuit 701 includes a microprocessor 702, a sensing electrode 703, the resonant circuit 704 and an impedance element 707. Since the operation of the integrated communication and capacitive sensing circuit 701 is the same as the operation of the integrated communication and capacitive sensing circuit 301, the detail description is omitted. The difference is the impedance element 707 is coupled between the first I/O pin IO1 and the common voltage VSS. In this embodiment, the impedance element 707 is a resistor for example. When the integrated communication and capacitive sensing circuit 701 is operated in the capacitive sensing period T_sense, the resistor 707 is used to providing a discharging path such that the capacitive sensing can be more accurate.

In the abovementioned capacitive sensing period T_sense, the sensing electrode (303, 703) is to be discharged from VDD to VDD/2 for example, people having ordinary skill in the art should know that the voltages VDD and VDD/2 can be changed. For example, the sensing electrode (303, 307) may be discharged from VDD to 0.25 VDD. Thus, the present invention is not limited thereto.

Further, in the capacitive sensing period, the discharging voltage (VDD/2) is fixed, and the microprocessor calculates the discharging time through the I/O pin to determine whether the capacitance value of the sensing electrode is changed or not. However, from the abovementioned embodiment, people having ordinary skill in the art can understand the discharging time also can be fixed. The microprocessor (302, 702) can also determines whether the capacitance value is changed by the voltage of the sensing electrode being discharged after the discharging time.

Figure 8:
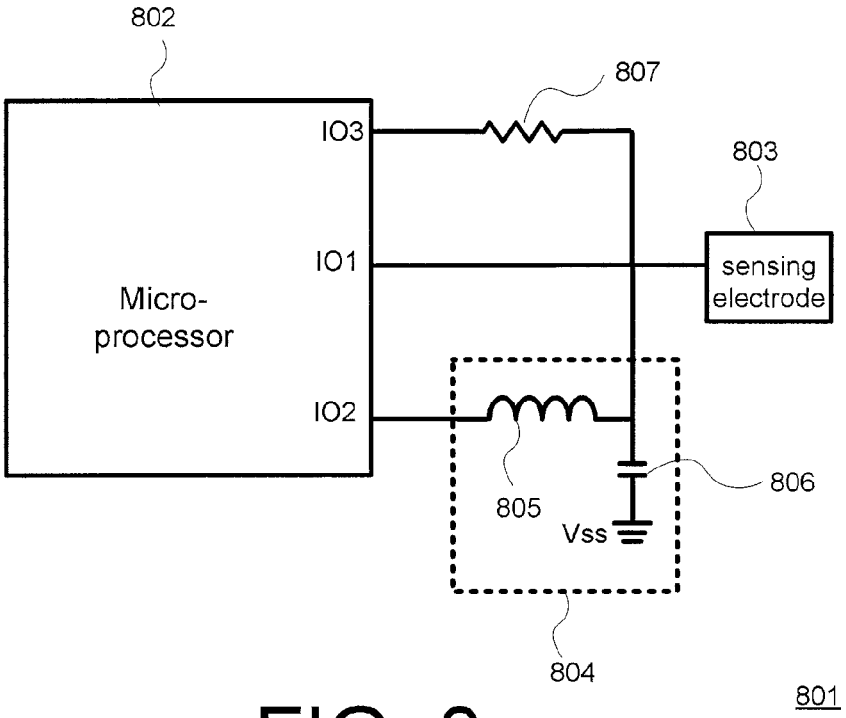
FIG. 8 illustrates a circuit diagram of the first interactive device 201 according to a preferred embodiment of the present invention.

In order to let people having ordinary skill in the art be able to implement the present invention, another embodiment is provided to describe the circuit of the interactive device. FIG. 8 illustrates a circuit diagram of the first interactive device 201 according to a preferred embodiment of the present invention. Referring to FIG. 8, the interactive device 201 includes an integrated communication and capacitive sensing circuit 801. The integrated communication and capacitive sensing circuit 801 includes a microprocessor 802, a sensing electrode 803, a resonant circuit 804 and an impedance element 807. The microprocessor 802 in this embodiment includes a first I/O pin IO1, a second I/O pin IO2 and a third I/O pin IO3. The sensing electrode 803 is coupled to the first I/O pin IO1 of the microprocessor 802. In this embodiment, the resonant circuit 804 is implemented by an inductor 805 and a capacitor 806, which is the same as the circuit in FIG. 3. The impedance element 807 in this embodiment is implemented by a resistor, whose one terminal is coupled to the third I/O pin IO3 of the microprocessor 802 and the other terminal is coupled to the sensing electrode 803.

Figure 9:
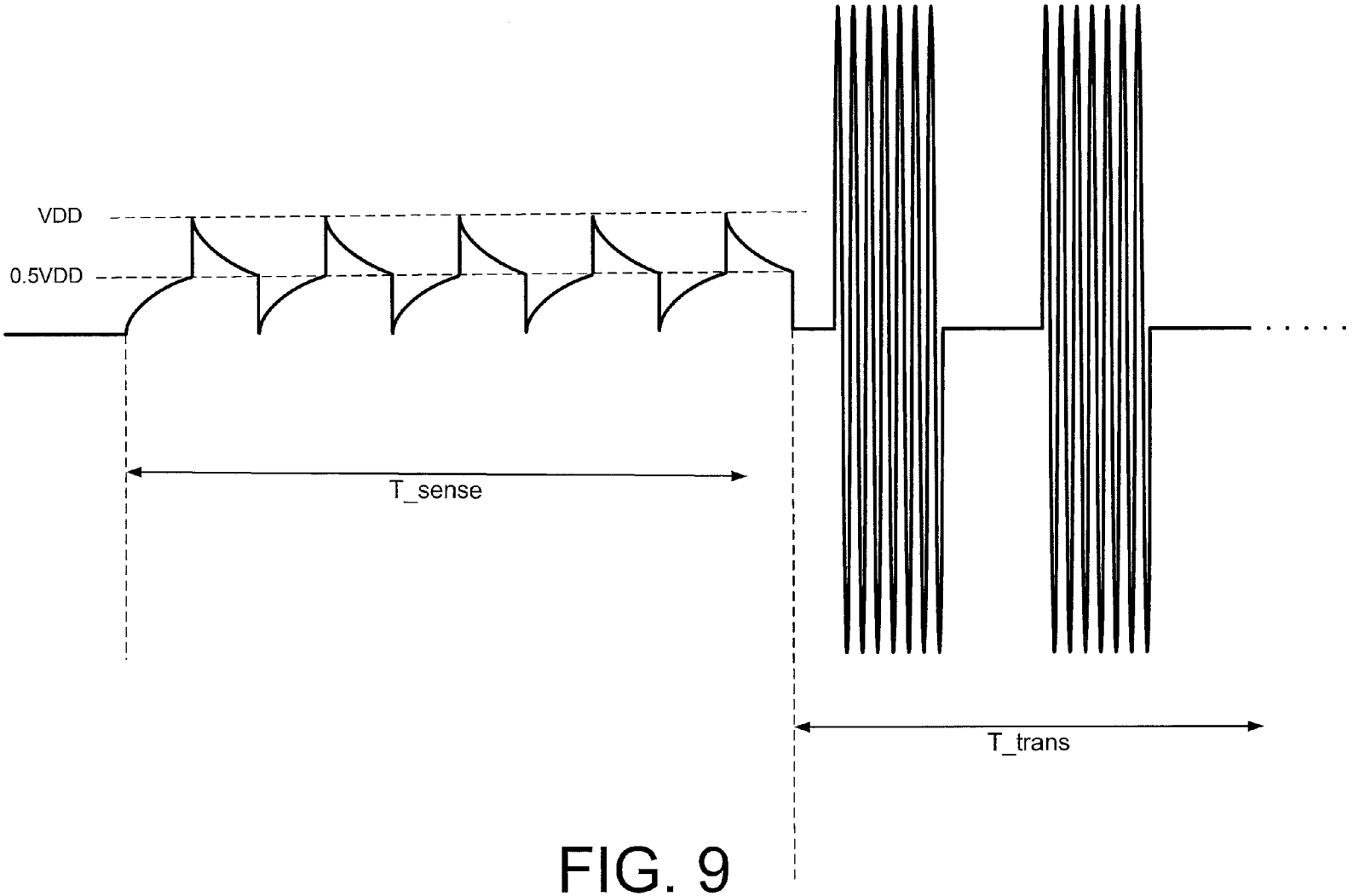
FIG. 9 illustrates an operational waveform diagram of the integrated communication and capacitive sensing circuit 801 according to a preferred embodiment of the present invention.

FIG. 9 illustrates an operational waveform diagram of the integrated communication and capacitive sensing circuit 801 according to a preferred embodiment of the present invention. Referring to FIG. 8 and FIG. 9, the waveform 901 is the waveform of the first I/O pin of the microprocessor 802. The operation of the integrated communication and capacitive sensing circuit 801 is divided into two periods, which is the capacitive sensing period T_sense and the data transmission period T_trans. In the data transmission period T_trans, the operation in the second I/O pin IO2 of the microprocessor 802 is the same as the operation in the second I/O pin IO2 of the microprocessor 302. Thus, the detail description is omitted. The first I/O pin IO1 and the third I/O pin IO3 of the microprocessor 802 are set to high impedance. Moreover, in the data transmission period T_trans, the interaction between the interactive devices is also described in the embodiments of FIG. 5 and FIG. 6. Thus, the detail description is omitted.

In the capacitive sensing period T_sense, the second I/O pin IO2 of the microprocessor 802 is set to high impedance. When the capacitive sensing is performed, the microprocessor 802 set the first I/O pin IO1 to the common voltage VSS. Next, the microprocessor 802 set the first I/O pin IO1 to high impedance. At the same time, the third I/O pin IO3 is set to VDD to charge the sensing electrode 803 and the capacitor 806. Meanwhile, the first I/O pin IO1 is for detecting the voltage of the sensing electrode 803. When the sensing electrode 803 and the capacitor 806 is charged to the first voltage, such as VDD/2, the first I/O pin IO1 of the microprocessor 802 is set to VDD. Next, the first I/O pin IO1 of the microprocessor 802 is set to high impedance, and the third I/O pin IO3 of the microprocessor 802 is set to the common voltage VSS such that the sensing electrode 803 and the capacitor 806 can be discharged through the resistor 807. At this time, the first I/O pin IO1 is for detecting the voltage of the sensing electrode 803.

Figure 10:
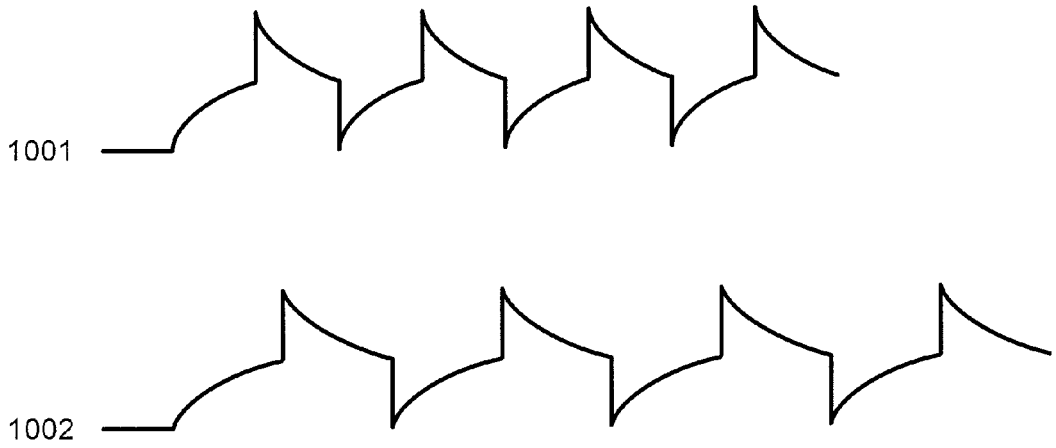
FIG. 10 illustrates a waveform diagram depicting a charging/discharging state of the sensing electrode 803 in a capacitive sensing period T_sense according to a preferred embodiment of the present invention.

Next, when the sensing electrode 803 and the capacitor 806 is discharged to the second voltage, such as VDD/2, the first I/O pin IO1 of the microprocessor 802 is set to the common voltage VSS, and the first I/O pin IO1 of the microprocessor 802 is set to high impedance, and the third I/O pin IO3 of the microprocessor 802 is set to VDD such that the sensing electrode 803 and the capacitor 806 start being charged again. And the charging operation and the discharging operation are repeated. FIG. 10 illustrates a waveform diagram depicting a charging/discharging state of the sensing electrode 803 in a capacitive sensing period T_sense according to a preferred embodiment of the present invention. When the sensing electrode 803 is not being touched, its equivalent capacitance is not to be changed. Thus, the voltage waveform measured at first I/O pin IO1 would be a periodic waveform, as the waveform 1001. When a conductor or user touches the sensing electrode 803, its equivalent capacitance become greater. Thus, the period of the voltage waveform measured at first I/O pin IO1 would become greater, as the waveform 1002. Thus, the microprocessor 802 can just detect the time, when the sensing electrode 803 charges from the common voltage VSS to the first voltage, plus the time, when the sensing electrode 803 discharges from VDD to the second voltage, to determine the capacitance variation of the sensing electrode 803 and to determine whether the sensing electrode 803 is touched (approached) or not.

The abovementioned first voltage is a preset voltage for charging target, and the abovementioned second voltage is a preset voltage for discharging target. In order to conveniently describe the present invention, the first and the second voltage are VDD/2 in the waveform in FIG. 9. However, people having ordinary skill in the art should know that the first voltage and the second voltage may be different voltages. For example, the first voltage may be 0.75 VDD; the second voltage may be 0.25 VDD. Thus, if the preset voltage(s) can be used for charging/discharging the sensing electrode, and the microprocessor can detects the capacitance variation through the charging/discharging period, the preset voltage(s) can be used to be the first voltage and the second voltage.

In addition, in the process of voltage charging for the sensing electrode, the third I/O pin is set to VDD. However, people having ordinary skill in the art should know that it can achieve the charging voltage for the sensing electrode if the voltage of the third I/O pin is greater than the first voltage. Thus, the present invention is not limited that the voltage of the third I/O pin is VDD when the sensing electrode is charged. Similarly, in the process of voltage discharging for the sensing electrode, the third I/O pin is set to the common voltage VSS. However, people having ordinary skill in the art should know that it can achieve the discharging voltage for the sensing electrode if the voltage of the third I/O pin is smaller than the second voltage. Thus, the present invention is not limited that the voltage of the third I/O pin is the common voltage VSS when the sensing electrode is discharged.

In the abovementioned embodiment, the charging/discharging target voltages are fixed, and the microprocessor determines the capacitance variation of the sensing electrode according to the period when the sensing electrode is charged to the charging target voltage to the period when the sensing electrode is discharged to the discharging target voltage. However, people having ordinary skill in the art should know that the charging/discharging period can also be fixed. The microprocessor just detects the voltage at the end of the charging/discharging period such that the microprocessor can determine the capacitance variation of the sensing electrode. An exemplary embodiment, which the charging/discharging periods are fixed to determine the capacitance variation of the sensing electrode, is provided as below.

In the capacitive sensing period T_sense, the second I/O pin IO2 of the microprocessor 802 is set to high impedance. When the capacitive sensing is performed, the microprocessor 802 set the first I/O pin IO1 to the common voltage VSS. Next, the microprocessor 802 set the first I/O pin IO1 to high impedance. Meanwhile, the third I/O pin is set to VDD so as to charge the sensing electrode 803 and the capacitor 806.

When the sensing electrode 803 starts to be charged, the microprocessor 802 starts counting a first preset period. When the first preset period is expired, the microprocessor 802 detects and records the voltage of the sensing electrode 803, where the recorded voltage of the sensing electrode 803 is a first time-point voltage. Next, the microprocessor 802 set the first I/O pin IO1 to VDD. Afterward, the first I/O pin IO1 is set to high impedance. And then the third I/O pin IO3 is set to the common voltage VSS so that the voltage of the sensing electrode 803 and the capacitance 806 can be discharged through the resistor 807.

Figure 11:
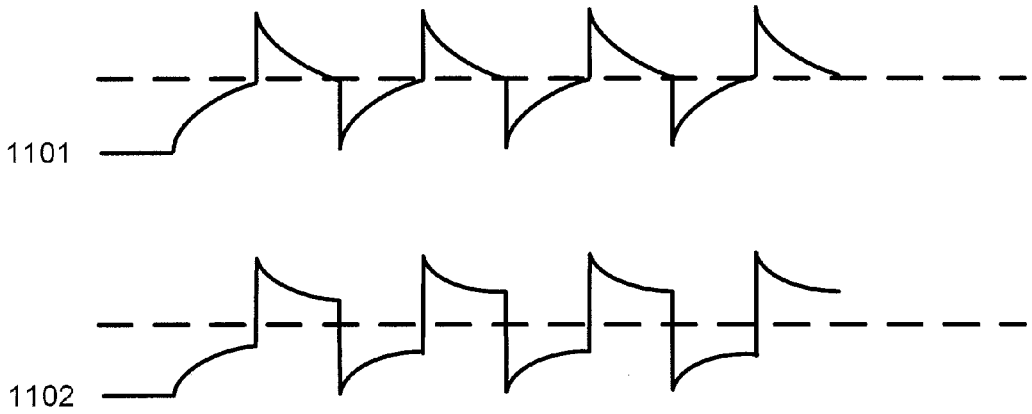
FIG. 11 illustrates a waveform diagram depicting a charging/discharging state of the sensing electrode 803 in a capacitive sensing period T_sense according to a preferred embodiment of the present invention.

When the sensing electrode 803 starts to be discharged, the microprocessor 802 starts counting a second preset period. When the second preset period is expired, the microprocessor 802 detects and records the voltage of the sensing electrode 803, where the recorded voltage of the sensing electrode 803 is a second time-point voltage. Next, the microprocessor 802 set the first I/O pin IO1 to the common voltage VSS. Afterward, the first I/O pin IO1 of the microprocessor 802 is set to high impedance. And then the third I/O pin IO3 is set to VDD so that the voltage of the sensing electrode 803 and the capacitance 806 can be charged. And the charging operation and the discharging operation are repeated. FIG. 11 illustrates a waveform diagram depicting a charging/discharging state of the sensing electrode 803 in a capacitive sensing period T_sense according to a preferred embodiment of the present invention. Since the sensing electrode 803 is not touched, its equivalent capacitance is not changed. Thus, the waveform measured on the first I/O pin IO1 would be a periodic waveform, as the waveform 1101. When the sensing electrode 803 is touched or a conductor is close to the sensing electrode 803, its equivalent capacitance would become greater. The period of the waveform detected from the first I/O pin IO1 would be greater, as the waveform 1102. Thus, the microprocessor 802 can determines the capacitance variation of the sensing electrode 803 according to the first time-point voltage and the second time-point voltage and thus determines whether the sensing electrode is touch or not.

In FIG. 3, FIG. 7 and FIG. 8 of the abovementioned embodiment, the resonant circuits (304, 704, and 804) are implemented by series combination of one inductor and one capacitor. The second I/O pin IO2 which is coupled to the resonant circuit is operated in high impedance and only the first I/O pin IO1 is used for detecting voltage. The third I/O pin IO3 is used for charging/discharging the sensing electrode. In the following embodiment, a resistor is disposed on the resonant circuit, and the second I/O pin IO2 can be used for charging/discharging the sensing electrode in the capacitive sensing period T_sense.

Figure 12:
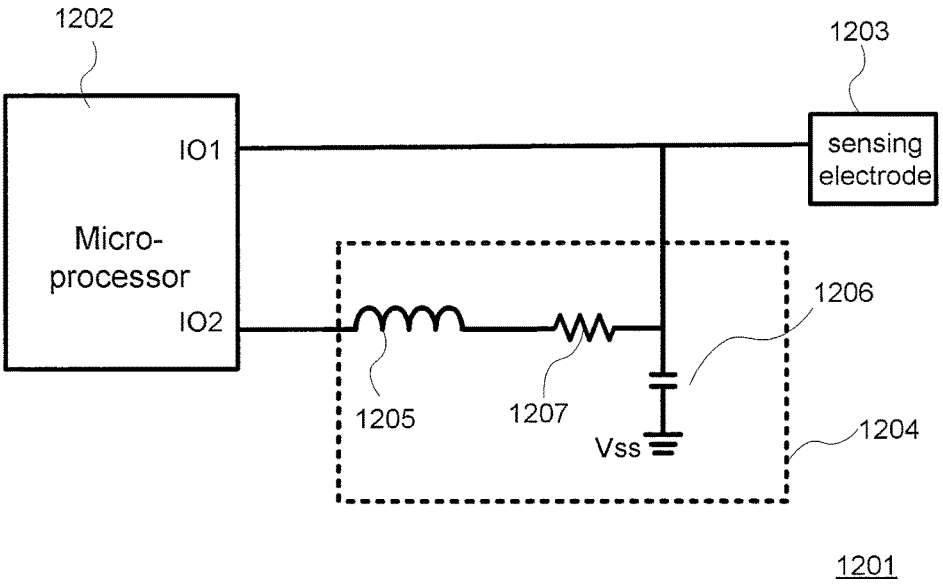
FIG. 12 illustrates a circuit diagram of the first interactive device 201 according to a preferred embodiment of the present invention.

FIG. 12 illustrates a circuit diagram of the first interactive device 201 according to a preferred embodiment of the present invention. Referring to FIG. 12, the interactive device 201 includes an integrated communication and capacitive sensing circuit 1201. The integrated communication and capacitive sensing circuit 1201 includes a microprocessor 1202, a sensing electrode 1203 and a resonant circuit 1204. The resonant circuit 1204 includes an inductor 1205, a capacitor 1206 and a resistor 1207. One terminal of the resistor 1207 is coupled to the inductor 1205, the other terminal of the resistor 1207 is coupled to the capacitor 1206 and the sensing electrode 1203. In addition, the operational waveform of the integrated communication and capacitive sensing circuit 1201 in the present embodiment is the same as the waveform in FIG. 9.

Since the circuit is operated at low frequency in the capacitive sensing period T_sense, the inductor 1205 can be considered as short circuit in the capacitive sensing period T_sense. In the capacitive sensing period T_sense, the second I/O pin IO2 of the microprocessor 1202 is for charging/discharging the sensing electrode 1203. The operation thereof is the same as the operation of the third I/O pin IO3 in FIG. 8. In the capacitive sensing period T_sense, the first I/O pin IO1 of the microprocessor is for detecting the voltage. The operation thereof is the same as the operation of the first I/O pin IO1 in FIG. 8. The detail description thereof is omitted. Next, in the data transmission period, the operation of the first I/O pin IO1 and the operation of the second I/O pin IO2 are respectively the same as the operation of the first I/O pin IO1 in FIG. 3 and the operation of the second I/O pin IO2 in FIG. 3. Therefore, the detail description thereof is omitted.

The resistor 1207 is coupled between the inductor 1205 and the sensing electrode 1203. However, people having ordinary skill in the art should know that the resistor 1207 can be coupled between the second I/O pin IO2 and the inductor 1205.

Figure 13:
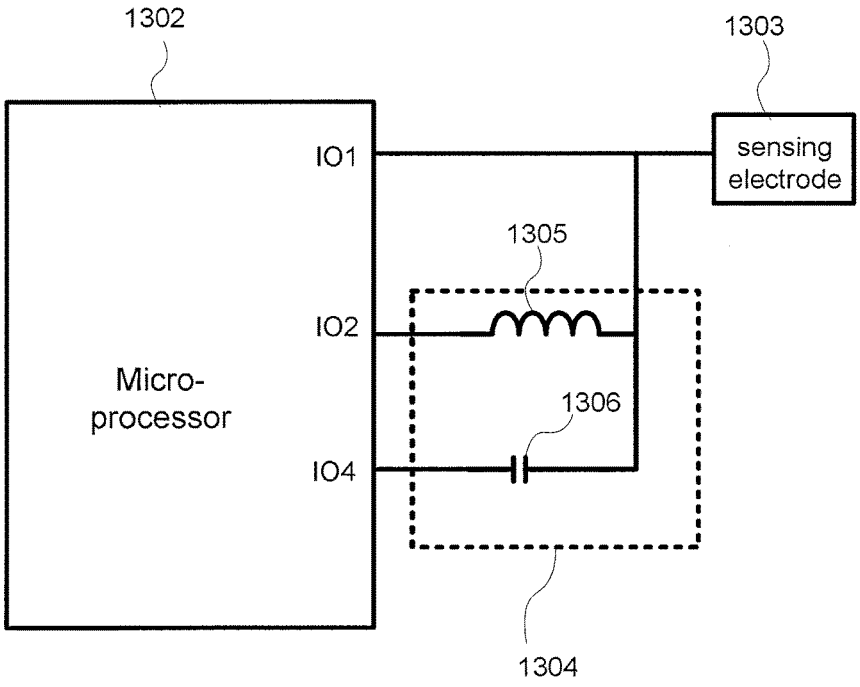
FIG. 13 illustrates a circuit diagram of the first interactive device 201 according to a preferred embodiment of the present invention.

The resonant circuits (304, 704, 804, 1204), which are respectively in FIG. 3, FIG. 7, FIG. 8 and FIG. 12, are the series combination of inductor and capacitor as example. In order to let people having ordinary skill in the art be able to implement the present invention, the following embodiment adopts the parallel combination of inductor and capacitor as example. FIG. 13 illustrates a circuit diagram of the first interactive device 201 according to a preferred embodiment of the present invention. Referring to FIG. 13, the interactive device 201 includes an integrated communication and capacitive sensing circuit 1301. The integrated communication and capacitive sensing circuit 1301 includes a microprocessor 1302, a sensing electrode 1303 and a resonant circuit 1304. The microprocessor 1302 in this embodiment at least includes three pins, which are the first I/O pin IO1, the second I/O pin IO2 and the fourth I/O pin IO4. The sensing electrode 1303 is coupled to the first I/O pin IO1 of the microprocessor 1302. The resonant circuit 1304 includes an inductor 1305, a capacitor 1306. One terminal of the inductor 1305 is coupled to the second I/O pin IO2, and the other terminal of the inductor 1305 is coupled to the sensing electrode 1303. One terminal of the capacitor 1306 is coupled to the fourth I/O pin IO4, and the other terminal of the capacitor 1306 is coupled to the sensing electrode 1303. The operational waveform of the integrated communication and capacitive sensing circuit 1301 is substantially the same as the waveform in FIG. 4.

In the capacitive sensing period T_sense, the second I/O pin IO2 of the microprocessor 1302 and the fourth I/O pin IO4 of the microprocessor 1302 are set to high impedance. And the first I/O pin IO1 of the microprocessor 1302 is for charging/discharging the sensing electrode 1303, wherein the operation of the first I/O pin IO1 of the microprocessor 1303 is substantially the same as the first I/O pin IO1 of the microprocessor 302 in FIG. 3, thus the detail description of the same part is omitted. The different part is that the fourth I/O pin IO4 of the microprocessor 1302 maintains high impedance in the capacitive sensing period T_sense. Thus, when the first I/O pin IO1 of the microprocessor 1302 charges/discharges the sensing electrode 1303, the capacitor 1306 is not charged/discharged.

Further, in the data transmission period T_trans, the first I/O pin IO1 of the microprocessor 1302 is set to high impedance, and the fourth I/O pin IO4 of the microprocessor 1302 is set to the common voltage VSS. The microprocessor 1302 determines whether a high frequency carrier signal on the second I/O pin is enabled or not according to the transmission data. The frequency of the high frequency carrier signal approaches the resonant frequency of the resonant circuit 1304. Thus, the magnitude of the high frequency carrier signal would be amplified by the resonance of the resonant circuit 1304. Then the sensing electrode 1303 outputs the amplified high frequency carrier signal.

In the abovementioned resonant circuit in FIG. 3, its circuit is series combination of the inductor 305 and the capacitor 306. When the sensing electrode 303 is charged/ discharged, the capacitor 306 of the resonant circuit 304 is also charged/discharged. When the capacitance of the sensing electrode 303 is changed by touch, the sensitivity of the detected capacitance variation detected by the microprocessor 302 would become lower since the amount of the capacitance variation may be too small than the capacitance of the capacitor 306. Therefore, in practical use of the circuit, the capacitor 306 cannot be designed with large capacitance. Comparing with the resonant circuit 1304 in FIG. 13, its circuit is parallel combination of the capacitor 1306 and the inductor 1305, and the microprocessor 1302 uses the other pin to coupled to the capacitor 1306. The coupling relationship of the resonant circuit 1304 causes that the capacitor 1306 is not be charged/discharged in the capacitive sensing period. Thus, when the capacitance of the sensing electrode 1303 is varied by touch, the microprocessor 1302 can detect the capacitance variation of the sensing electrode 1303 with higher sensitivity. And, in practical use of the circuit, the capacitor 1306 can be correctly designed corresponding to the resonant frequency.

Figure 14:
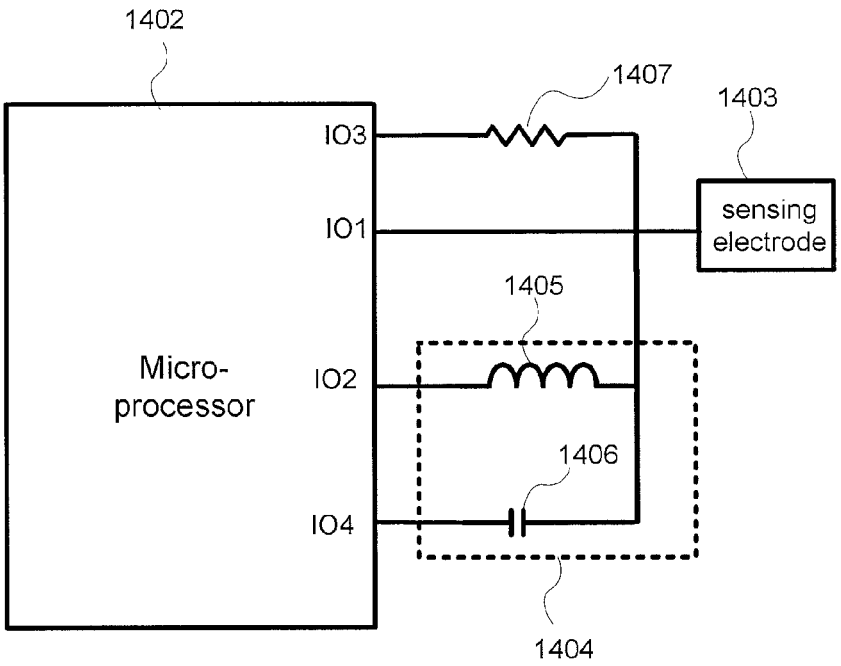
FIG. 14 illustrates a circuit diagram of the interactive device 201 according to a preferred embodiment of the present invention.

In order to let people having ordinary skill in the art be able to implement the present invention, another embodiment is provided to describe the circuit design of the interactive device. FIG. 14 illustrates a circuit diagram of the interactive device 201 according to a preferred embodiment of the present invention. Referring to FIG. 14, the interactive device 201 includes an integrated communication and capacitive sensing circuit 1401. The integrated communication and capacitive sensing circuit 1401 includes a microprocessor 1402, a sensing electrode 1403, the resonant circuit 1404 and an impedance element 1407. the microprocessor 1402 in this embodiment includes a first I/O pin IO1, a second I/O pin IO2, a third I/O pin IO3 and fourth I/O pin IO4. The sensing electrode 1403 is coupled to the first I/O pin IO1 of the microprocessor 1402. In this embodiment, the resonant circuit 1404 includes an inductor 1405 and a capacitor 1406, the coupling relationship is substantially the same as the circuit in FIG. 13. The impedance element 1407 in this embodiment is implemented by a resistor, where one terminal thereof is coupled to the third I/O pin IO3 of the microprocessor 1402, and the other terminal thereof is coupled to the sensing electrode 1403.

The operational waveform of the integrated communication and capacitive sensing circuit 1401 is substantially the same as the waveform in FIG. 9. The waveform 901 may be the waveform of the first I/O pin IO1 of the microprocessor 1402. The operation of the integrated communication and capacitive sensing circuit 1401 is divided into a capacitive sensing period T_sense and a data transmission period T_trans. In the capacitive sensing period T_sense, the second I/O pin IO2 and the fourth I/O pin IO4 of the microprocessor 1402 maintain in high impedance. Moreover, in the capacitive sensing period T_sense, the first I/O pin IO1 of the microprocessor 1402 is substantially the same as the first I/O pin IO1 of the microprocessor 802 in FIG. 8. Similarly, in the capacitive sensing period T_sense, the third I/O pin IO3 of the microprocessor 1402 is substantially the same as the first I/O pin IO3 of the microprocessor 802 in FIG. 8.

In the data transmission period T_trans, the first I/O pin IO1 and the third I/O pin IO3 of the microprocessor 1402 are set to high impedance, and the fourth I/O pin IO4 of the microprocessor 1402 is set to the common voltage. The microprocessor 1402 determines whether a high frequency carrier signal of the second I/O pin IO2 is enabled or not according to a transmission data. Since the frequency of the high frequency carrier signal is close to the resonant frequency of the resonant circuit 1404, the magnitude of the high frequency carrier signal is amplified by the resonance of the resonant circuit 1404. And the amplified high frequency carrier signal is output by the sensing electrode 1403.

Figure 15:
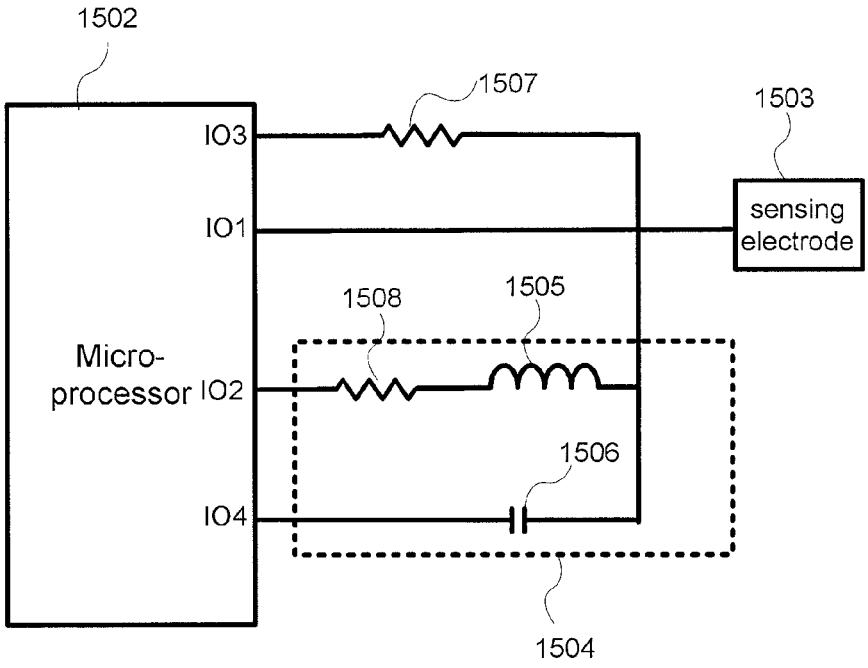
FIG. 15 illustrates a circuit diagram of the interactive device 201 according to a preferred embodiment of the present invention.

FIG. 15 illustrates a circuit diagram of the interactive device 201 according to a preferred embodiment of the present invention. Referring to FIG. 15, the interactive device 201 includes an integrated communication and capacitive sensing circuit 1501. The integrated communication and capacitive sensing circuit 1501 includes a microprocessor 1502, a sensing electrode 1503, a resonant circuit 1504 and an impedance element 1507. The circuit element and its coupling relationship of the integrated communication and capacitive sensing circuit 1501 is similar to the circuit in FIG. 14, thus the detail description of the same part is omitted. The difference between the circuit in FIG. 15 and the circuit in FIG. 14 is that the resonant circuit 1504 not only includes an inductor 1505 and a capacitor 1506, but a resistor 1508, where the resistor 1508 in this embodiment is coupled between the second I/O pin IO2 of the microprocessor 1502 and the inductor 1505. Further, the resistor 1508 in this embodiment ma be coupled between the sensing electrode 1503 and the inductor 1505. The resistor 1508 is used for adjusting the quality factor of the resonant circuit 1504. Moreover, the circuit operation in FIG. 15 is substantially the same as the circuit operation in FIG. 14, thus the detail description is omitted.

Figure 16:
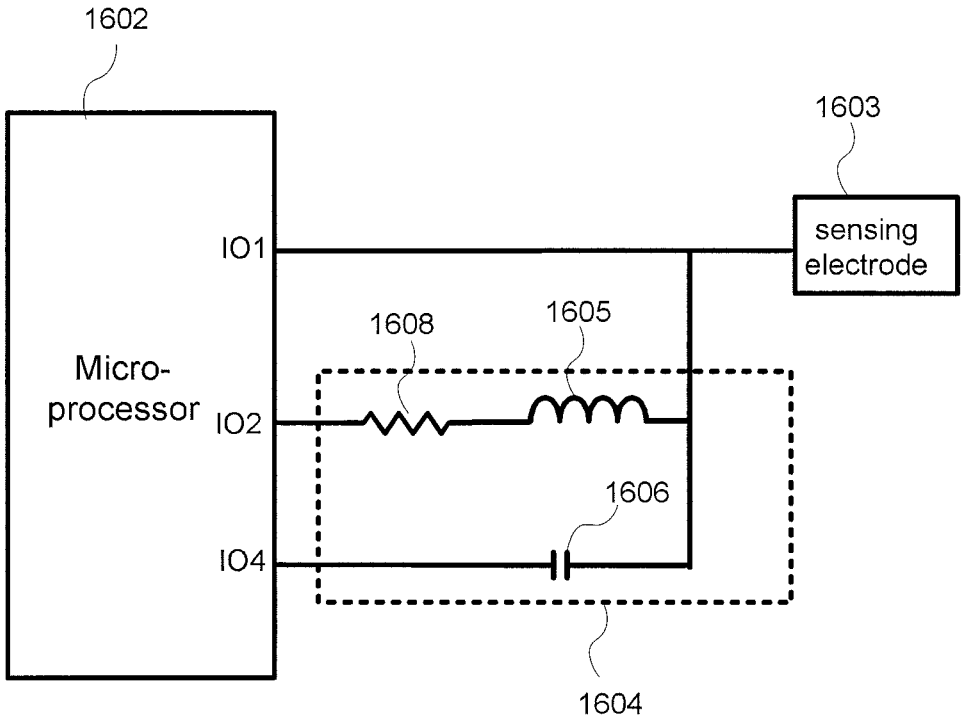
FIG. 16 illustrates a circuit diagram of the interactive device 201 according to a preferred embodiment of the present invention.

In order to let people having ordinary skill in the art be able to implement the present invention, another embodiment is provided to describe the circuit of the interactive device. FIG. 16 illustrates a circuit diagram of the interactive device 201 according to a preferred embodiment of the present invention. Referring to FIG. 16, the interactive device 201 includes an integrated communication and capacitive sensing circuit 1601. The integrated communication and capacitive sensing circuit 1601 includes a microprocessor 1602, a sensing electrode 1603 and a resonant circuit 1604. The resonant circuit 1604 includes an inductor 1605, a capacitor 1606 and a resistor 1608. The coupling relationship of the resonant circuit 1604 is substantially the same as the coupling relationship of the resonant circuit 1504 in FIG. 15. Thus, the detail description is omitted.

In the capacitive sensing period T_sense, the operation of the integrated communication and capacitive sensing circuit 1601 is similar to the operation of the integrated communication and capacitive sensing circuit 1301. In other words, in the capacitive sensing period T_sense, the operation of the first I/O pin IO1 of the microprocessor 1602 is substantially the same as the operation of the first I/O pin IO1 of the microprocessor 1302. At this period, the first I/O pin IO1 of the microprocessor 1602 is used for charging/discharging the sensing electrode 1603, and the first I/O pin IO1 of the microprocessor 1602 is used to detect the voltage of the sensing electrode 1603 for capacitive sensing when the first I/O pin IO1 of the microprocessor 1602 is set to high impedance. In the capacitive sensing period T_sense, the second I/O pin IO2 and the fourth I/O pin IO4 of the microprocessor 1302 are set to high impedance.

In addition, since the resistor is provided in the resonant circuit 1604, the second I/O pin IO2 would not be set to high impedance in the capacitive sensing period T_sense, and it can charge/discharge the sensing electrode 1603. In other words, in the capacitive sensing period T_sense, the operation of the second I/O pin IO2 of the microprocessor 1602 is similar to the operation of the second I/O pin IO2 of the microprocessor 1202 in FIG. 12. Similarly, in the capacitive sensing period T_sense, the operation of the second I/O pin IO2 of the microprocessor 1602 is similar to the operation of the third I/O pin IO3 of the microprocessor 802. The first I/O pin IO1 of the microprocessor 1602 is used for detecting voltage, wherein in the capacitive sensing period T_sense, the operation of the first I/O pin IO1 of the microprocessor 1602 is similar to the operation of the first I/O pin IO1 of the microprocessor 1202 in FIG. 12. And the fourth I/O pin IO4 of the microprocessor 1602 is set to high impedance. Furthermore, in the data transmission period T_trans, the operations of the three I/O pins (IO1~IO3) of the microprocessor 1602 are substantially the same as the operations of the three I/O pins (IO1~IO3) of the microprocessor 1302 in FIG. 13.

Although the above-mentioned embodiments are described with one inductor and one capacitor or one inductor, one capacitor and one resistor serving as resonant circuit, people having ordinary skilled in the art should know that the resonant circuit can be implemented by multiple inductors and multiple capacitors. Therefore, the present invention is not restricted thereto.

In summary, the essence of the present invention is to output a high frequency carrier signal from a I/O pin of the microprocessor and then to use the resonant circuit which resonates the high frequency carrier signal such that the electric field of the high frequency carrier signal is amplified and the sensing electrode can emits the amplified electric field of the high frequency carrier signal. Moreover, the other pin of the microprocessor is used to sense the capacitance of the sensing electrode. Thus, the circuit design provided by the present invention adopts the same sensing electrode to achieve the data transceiving function and the capacitance sensing function. Further, the preferred embodiment of the present invention adopts lesser discrete components to achieve the data transceiving function and the capacitance sensing function. Thus, it greatly reduces the circuit complexity and the occupied area of components.

While the present invention has been described by way of examples and in terms of preferred embodiments, it is to be understood that the present invention is not limited thereto. To the contrary, it is intended to cover various modifications. Therefore, the scope of the appended claims should be accorded the broadest interpretation so as to encompass all such modifications.

What is claimed is:

1. An integrated communication and capacitive sensing circuit, comprising:

a microprocessor, comprising a first input/output pin and a second input/output pin;

a sensing electrode, coupled to the first input/output pin of the microprocessor; and a resonant circuit, comprising an input terminal and an output terminal, wherein the input terminal of the resonant circuit is coupled to the second input/output pin of the microprocessor, wherein the output terminal of the resonant circuit is coupled to the sensing electrode, wherein, when a capacitive sensing is performed, the microprocessor determines the capacitive variation of the sensing electrode according to the charging/discharging status of the sensing electrode from the first input/output pin, wherein, when a data transmission is performed, the first input/output pin of the microprocessor is set to high impedance, a high frequency carrier signal of the second input/output pin of the microprocessor is enabled/disabled according to a transmission data, wherein a magnitude of the high frequency carrier signal is amplified by the resonant circuit, wherein the microprocessor comprises:

a third input/output pin, wherein the integrated communication and capacitive sensing circuit further comprises:

a impedance element, comprising a first terminal and a second terminal, wherein the first terminal of the impedance element is coupled to the third input/output pin of the microprocessor, and the second terminal of the impedance element is coupled to the first input/output pin of the microprocessor, wherein, when the capacitive sensing is performed, the first input/output pin of the microprocessor is set to a first common voltage, and then the first input/output pin of the microprocessor is set to high impedance, and the third input/output pin of the microprocessor is set to a first specific voltage, when a voltage of the sensing electrode is charged from the first common voltage to a first voltage, the first input/output pin of the microprocessor is set to a second common voltage, the first input/output pin of the microprocessor is set to high impedance, and the third input/output pin of the microprocessor is set to a second specific voltage, wherein, when the sensing electrode is discharged from the second common voltage to a second voltage, the first input/output pin of the microprocessor is set to the first common voltage, and then the first input/output pin of the microprocessor is set to high impedance, and the third input/output pin of the microprocessor is set to the first specific voltage, wherein the microprocessor determines the capacitive variation of the sensing electrode according to a period when the sensing electrode is charged from the first common voltage to the first voltage plus a period when the sensing electrode is discharged from the second common voltage to the second voltage, wherein the first specific voltage is greater than or equal to the first voltage, and the first voltage is greater than the first common voltage, wherein the second specific voltage is smaller than or equal to the second voltage, and the second voltage is smaller than the second common voltage.

2. An integrated communication and capacitive sensing circuit, comprising:

a microprocessor, comprising a first input/output pin and a second input/output pin;

a sensing electrode, coupled to the first input/output pin of the microprocessor; and a resonant circuit, comprising an input terminal and an output terminal, wherein the input terminal of the resonant circuit is coupled to the second input/output pin of the microprocessor, wherein the output terminal of the resonant circuit is coupled to the sensing electrode, wherein, when a capacitive sensing is performed, the microprocessor determines the capacitive variation of the sensing electrode according to the charging/discharging status of the sensing electrode from the first input/output pin, wherein, when a data transmission is performed, the first input/output pin of the microprocessor is set to high impedance, a high frequency carrier signal of the second input/output pin of the microprocessor is enabled/disabled according to a transmission data, wherein a magnitude of the high frequency carrier signal is amplified by the resonant circuit, wherein the microprocessor comprises:

a third input/output pin, wherein the integrated communication and capacitive sensing circuit further comprises:

a impedance element, comprising a first terminal and a second terminal, wherein the first terminal of the impedance element is coupled to the third input/output pin of the microprocessor, and the second terminal of the impedance element is coupled to the first input/output pin of the microprocessor, wherein, when the capacitive sensing is performed, the first input/output pin of the microprocessor is set to a first common voltage, and then the first input/output pin of the microprocessor is set to high impedance, and the third input/output pin of the microprocessor is set to a first specific voltage such that the sensing electrode is charged from the third input/output pin of the microprocessor, wherein, after a first preset period, the microprocessor records a first time-point voltage of the sensing electrode, the first input/output pin of the microprocessor is set to a second common voltage, and then the first input/output pin of the microprocessor is set to high impedance, and the third input/output pin of the microprocessor is set to a second specific voltage such that the sensing electrode is discharged to the third input/output pin of the microprocessor, wherein, after a second period, the microprocessor records a second time-point voltage of the sensing electrode, the first input/output pin of the microprocessor is set to a first common voltage, and then the first input/output pin of the microprocessor is set to high impedance, and the third input/output pin of the microprocessor is set to a first specific voltage, wherein the microprocessor determines the capacitive variation of the sensing electrode according to the first time-point voltage and the second time-point voltage, wherein the first specific voltage is greater than or equal to the first time-point voltage, and the first time-point voltage is greater than the first common voltage, wherein the second specific voltage is smaller than or equal to the second time-point voltage, and the second time-point voltage is smaller than the second common voltage.

3. An integrated communication and capacitive sensing circuit, comprising:

a microprocessor, comprising a first input/output pin and a second input/output pin;

a sensing electrode, coupled to the first input/output pin of the microprocessor; and a resonant circuit, comprising an input terminal and an output terminal, wherein the input terminal of the resonant circuit is coupled to the second input/output pin of the microprocessor, wherein the output terminal of the resonant circuit is coupled to the sensing electrode, wherein, when a capacitive sensing is performed, the microprocessor determines the capacitive variation of the sensing electrode according to the charging/discharging status of the sensing electrode from the first input/output pin, wherein, when a data transmission is performed, the first input/output pin of the microprocessor is set to high impedance, a high frequency carrier signal of the second input/output pin of the microprocessor is enabled/disabled according to a transmission data, wherein a magnitude of the high frequency carrier signal is amplified by the resonant circuit, wherein the integrated communication and capacitive sensing circuit further comprises:

a impedance element, comprising a first terminal and a second terminal, wherein the first terminal of the impedance element is coupled to the first input/output pin of the microprocessor, and the second terminal of the impedance element is coupled to a common voltage, wherein, when the capacitive sensing is performed, the first input/output pin of the microprocessor charges the sensing electrode to a first voltage, and then the first input/output pin of the microprocessor is set to high impedance, wherein, when the sensing electrode is discharged to a second voltage, the microprocessor determines the capacitive variation of the sensing electrode according to a period when the sensing electrode discharged from the first voltage to the second voltage.

4. An integrated communication and capacitive sensing circuit, comprising:

a microprocessor, comprising a first input/output pin and a second input/output pin;

a sensing electrode, coupled to the first input/output pin of the microprocessor; and a resonant circuit, comprising an input terminal and an output terminal, wherein the input terminal of the resonant circuit is coupled to the second input/output pin of the microprocessor, wherein the output terminal of the resonant circuit is coupled to the sensing electrode, wherein, when a capacitive sensing is performed, the microprocessor determines the capacitive variation of the sensing electrode according to the charging/discharging status of the sensing electrode from the first input/output pin, wherein, when a data transmission is performed, the first input/output pin of the microprocessor is set to high impedance, a high frequency carrier signal of the second input/output pin of the microprocessor is enabled/disabled according to a transmission data, wherein a magnitude of the high frequency carrier signal is amplified by the resonant circuit, wherein the integrated communication and capacitive sensing circuit further comprises:

a impedance element, comprising a first terminal and a second terminal, wherein the first terminal of the impedance element is coupled to the first input/output pin, and the second terminal of the impedance element is coupled to a common voltage, wherein, when the capacitive sensing is performed, the first input/output pin of the microprocessor charges the sensing electrode to a first voltage, and then the first input/output pin of the microprocessor is set to high impedance, and after a preset period, the microprocessor determines the capacitive variation of the sensing electrode according to a voltage to which the sensing electrode discharged from the first voltage.

5. An integrated communication and capacitive sensing circuit, comprising:

a microprocessor, comprising a first input/output pin and a second input/output pin;

a sensing electrode, coupled to the first input/output pin of the microprocessor; and a resonant circuit, comprising an input terminal and an output terminal, wherein the input terminal of the resonant circuit is coupled to the second input/output pin of the microprocessor, wherein the output terminal of the resonant circuit is coupled to the sensing electrode, wherein, when a capacitive sensing is performed, the microprocessor determines the capacitive variation of the sensing electrode according to the charging/discharging status of the sensing electrode from the first input/output pin, wherein, when a data transmission is performed, the first input/output pin of the microprocessor is set to high impedance, a high frequency carrier signal of the second input/output pin of the microprocessor is enabled/disabled according to a transmission data, wherein a magnitude of the high frequency carrier signal is amplified by the resonant circuit, and the sensing electrode receives the amplified high frequency carrier signal from the output terminal of the resonant circuit, wherein the microprocessor comprises:

a fourth input/output pin, wherein the resonant circuit comprises:

a inductor, comprising a first terminal and a second terminal, wherein the first terminal of the inductor is coupled to the second input/output pin of the microprocessor, and the second terminal of the inductor is coupled to the sensing electrode; and a capacitor, comprising a first terminal and a second terminal, wherein the first terminal of the capacitor is coupled to the fourth input/output pin of the microprocessor, and the second terminal of the capacitor is coupled to the sensing electrode, wherein, when the data transmission is performed, the first input/output pin of the microprocessor is set to high impedance, and the fourth input/output pin of the microprocessor is set to a common voltage.

6. The integrated communication and capacitive sensing circuit according to claim 5, wherein the resonant circuit further comprises:

a resistor, comprising a first terminal and a second terminal, wherein the first terminal of the resistor is coupled to the second input/output pin of the microprocessor, the second terminal of the resistor is coupled to the first terminal of the inductor.

7. The integrated communication and capacitive sensing circuit according to claim 5, wherein, when the capacitive sensing is performed, the second input/output pin of the microprocessor and the fourth input/output pin of the microprocessor is set to high impedance.

8. The integrated communication and capacitive sensing circuit according to claim 1, wherein the microprocessor determines envelop of the high frequency carrier to decode a transmission data transmitted from an external circuit according to the time period of unstable capacitance of the sensing electrode detected by the first input/output pin of the microprocessor.

* * * * *